US010682565B1

(12) United States Patent
Woolson et al.

(10) Patent No.: US 10,682,565 B1
(45) Date of Patent: Jun. 16, 2020

(54) FOOT LIFT ATTACHMENTS FOR SKATEBOARDS AND COMBINATIONS THEREOF

(71) Applicant: FLIGHT FINS LLC, Mansfield, OH (US)

(72) Inventors: Michael Woolson, Los Angeles, CA (US); Orie Rush, Mansfield, OH (US)

(73) Assignee: FLIGHT FINS LLC, Mansfield, OH (US)

( * ) Notice: Subject to any disclaimer, the term of this patent is extended or adjusted under 35 U.S.C. 154(b) by 0 days.

(21) Appl. No.: 16/209,947

(22) Filed: Dec. 4, 2018

Related U.S. Application Data

(60) Provisional application No. 62/594,468, filed on Dec. 4, 2017.

(51) Int. Cl.
*A63C 17/08* (2006.01)
*A63C 17/26* (2006.01)
*A63C 17/01* (2006.01)

(52) U.S. Cl.
CPC ..... *A63C 17/262* (2013.01); *A63C 17/014* (2013.01); *A63C 17/08* (2013.01)

(58) Field of Classification Search
CPC .. A63C 1/02; A63C 1/00; A63C 1/015; A63C 1/014; A63C 1/017; A63C 1/0073; A63C 17/262
See application file for complete search history.

(56) References Cited

U.S. PATENT DOCUMENTS

| | | | | |
|---|---|---|---|---|
| 4,027,890 | A * | 6/1977 | Volkmann | A63C 17/01 188/2 R |
| 4,600,073 | A * | 7/1986 | Honett | B62M 27/02 180/181 |
| 5,460,558 | A | 10/1995 | Woodstock | |
| 5,484,312 | A | 1/1996 | Zepeda | |
| 6,199,881 | B1 | 3/2001 | Wood et al. | |
| 6,368,173 | B1 * | 4/2002 | Runyan | A43B 3/103 280/611 |
| 6,488,294 | B2 | 12/2002 | Lumb | |
| 8,210,304 | B2 * | 7/2012 | Baldwin | A63C 17/01 180/181 |
| 8,696,001 | B1 * | 4/2014 | Olsauskas | A63C 17/262 280/87.042 |
| 9,403,414 | B2 * | 8/2016 | DeFerrari | B60F 3/003 |

(Continued)

*Primary Examiner* — John D Walters
*Assistant Examiner* — James J Triggs
(74) *Attorney, Agent, or Firm* — Procopio, Cory, Hargreaves & Savitch LLP

(57) ABSTRACT

A pair of foot lift attachments for attachment to single-wheel motorized electric skateboards, and combinations thereof. The foot lift attachments include a right foot lift attachment and a left foot lift attachment, each having a first concave curved outer facing side wall configured to be engaged on a curved support surface of either of a fender covering the single wheel, or a curved support surface of a mounting bracket secured at each side of the opening for the single wheel, and each having a convex curved top end wall with a concave curved underside configured to laterally receive and overlap the medial side and a top portion of the skateboard rider's foot and footwear worn on the foot to enable the rider to lift the skateboard off the ground with their feet and perform freestyle skateboarding maneuvers and aerial moves and jumps.

11 Claims, 3 Drawing Sheets

(56) References Cited

U.S. PATENT DOCUMENTS

| | | | | |
|---|---|---|---|---|
| 9,457,260 | B2 * | 10/2016 | Weber | A63C 17/262 |
| 9,604,124 | B2 * | 3/2017 | Aders | A63C 17/004 |
| 9,707,470 | B2 * | 7/2017 | Ma | A63C 17/08 |
| 2003/0155734 | A1 * | 8/2003 | Leslie | A63C 17/01<br>280/87.042 |
| 2011/0291375 | A1 * | 12/2011 | Lawson | A63B 69/0093<br>280/87.042 |
| 2014/0091565 | A1 * | 4/2014 | Feyers | B62D 25/16<br>280/851 |
| 2016/0107070 | A1 * | 4/2016 | Middleton | A63C 17/012<br>280/87.042 |
| 2016/0121198 | A1 * | 5/2016 | Doerksen | A63C 17/01<br>701/22 |
| 2016/0184690 | A1 * | 6/2016 | Aders | A63C 17/004<br>180/20 |
| 2017/0259162 | A1 * | 9/2017 | Mo | A63C 17/12 |
| 2018/0161661 | A1 * | 6/2018 | Ma | A63C 17/014 |
| 2018/0296901 | A1 * | 10/2018 | Pembridge | A63C 5/03 |
| 2019/0015729 | A1 * | 1/2019 | Sullivan | A63C 17/014 |

* cited by examiner

FOOT LIFT ATTACHMENTS FOR SKATEBOARDS AND COMBINATIONS THEREOF

CROSS REFERENCE TO RELATED APPLICATION

This application claims priority of U.S. Provisional Application Serial No. Ser. No. 62/594,468 filed Dec. 4, 2017.

BACKGROUND OF THE INVENTION

1. Field of the Invention

This invention relates generally to skateboards and skateboard attachments and, more particularly, to foot lift attachments for attachment to motorized electric skateboards that enable a rider to lift the board off the ground with their feet and perform freestyle skateboarding maneuvers and aerial moves and jumps, and also relates to motorized electric skateboards equipped with such foot lift attachments.

2. Background Art

A conventional skateboard is comprised of an elongated board with a pair of front wheels and a pair of rear wheels. In addition to rolling along the ground and making turns, skillful skateboard riders can make complex maneuvers with a board. Many maneuvers involve jumping or lifting the board off the ground. A rider can either lift it by hand, or step on its rear end to pitch up the front end. These methods are difficult to master and are limiting in the type of maneuvers they enable a rider to perform.

More recently electric skateboards have become very popular. The electric skateboard no longer requires the propelling of the skateboard by means of the feet; rather an electric motor propels the board, fed by an electric battery. Electric skateboards are available with one, two and four driven wheels, with the driven wheels either power by a separately mounted electric motor connected by a toothed belt, or use wheel hub motors which have a brushless motor integrated into the wheel itself. The board of a single-wheel skateboard has a one central ground contacting wheel propelled by a hub motor and first and second deck portions at each side of the wheel configured to receive the left and right foot of a rider. The weight of an electric skateboard may be in the range of from about 25-27 lbs.

One of the problems with single-wheel electric skateboards is that the weight of the motor and battery, and the single ground contacting wheel, make it very difficult or impossible for the rider to perform freestyle skateboarding maneuvers and aerial moves and jumps which require the rider to lift the board off the ground with their feet.

There are several patents directed toward various devices that are adapted to assist riders in maintaining their balance and maneuverability when riding skateboards and surfboards. The following are several examples.

Woodstock, U.S. Pat. No. 5,460,558, discloses a surfboard foot saddle for a surf board having a deck, a nose end, and a tail end. The foot saddle is formed of two substantially L-shaped halves which when secured to the surf board form a substantially C-shaped member having a central split structure adjustable to fit any size foot, for maintaining one foot of a surfer in a stationary position upon the deck near the tail end of the surfboard, and help prevent the surfer's foot from inadvertently sliding off the surfboard. The other foot of the surfer is free to move upon the deck to ride the nose and the fin of the surfboard on the crests of waves with a better balance.

Zepeda, U.S. Pat. No. 5,484,312 discloses an improved surfboard foot piece for attachment to a surfboard. The foot piece has an elongated fin-like body formed of a rubber-like or resilient material having an elongated flat base for attachment to the deck of the surfboard. Inner and outer side surfaces project upwardly from the base and curve in the same direction terminating in a tip. The inner side surface and the adjoining deck provide a laterally unobstructed curved pocket for lateral engagement by the medial side of a surfer's foot. When a force is applied to the outer surface thereof, the fin-like body will be deformed, so that the tip will be forced downwardly toward the surfboard deck to provide an elongated curved surface for engagement by the sole of the user's foot. This also allows the foot piece to be pressed down against the deck by the surfer's knee for certain maneuvers or by the surfer's body when the surfer is lying flat on the surfboard swimming to catch the next wave.

Wood, et al, U.S. Pat. No. 6,199,881, discloses a skateboard stirrup comprised of a pair of hollow end caps for cupping over the front and rear ends of a skateboard, and a resilient band connected between the end caps. When the rider's feet are on top of the band, it is yielding enough to allow the feet to make full contact with the top of the board. When the rider's feet are inserted under the band, it is taut enough to lift the skateboard for airborne maneuvers when the feet are lifted.

Lumb, U.S. Pat. No. 6,488,294, discloses a skateboard attachment device having clips each include a lip or projection that allows a rider to position the sole of a shoe beneath the lip so as to secure the rider's shoe to the platform. The clip may be permanently or releasably secured and sized to fit conventional shoes. A professional version includes a specialty shoe that provides additional securement. Releasably secured clips may be concealed to allow the skateboard to be used in a conventional manner.

SUMMARY OF THE INVENTION

The present invention overcomes the aforementioned problems and is distinguished over the prior art in general, and these patents in particular by a pair of foot lift attachments for attachment to single-wheel motorized electric skateboards, and combinations thereof. The foot lift attachments include a right foot lift attachment and a left foot lift attachment, each having a first concave curved outer facing side wall configured to be engaged on a curved support surface of either of a fender covering the single wheel, or a curved support surface of a mounting bracket secured at each side of the opening for the single wheel, and each having a convex curved top end wall with a concave curved underside configured to laterally receive and overlap the medial side and a top portion of the skateboard rider's foot and footwear worn on the foot to enable the rider to lift the skateboard off the ground with their feet and perform freestyle skateboarding maneuvers and aerial moves and jumps.

One of the significant differences and advantages of the present foot lift attachments is that they allow a rider to easily lift a single-wheel skateboard off the ground with their feet for performing airborne maneuvers.

Another significant difference and advantage is that the foot lift attachments allow a rider to stand on the skateboard in a conventional manner.

Another significant difference and advantage is that the foot lift attachments do not limit a rider's freedom of movement, and allow the rider's foot to be easily removed therefrom.

Another significant difference and advantage is that the foot lift attachments may be easily retrofitted to a conventional single-wheel skateboard having a fender, or that do not have a fender.

Another significant difference and advantage is that it the foot lift attachments may be secured to a skateboard fender or integrally formed on the fender during a molding operation to form a fender for attachment to a skateboard.

Other significant differences and advantages of the invention will become apparent from time to time throughout the specification and claims as hereinafter related.

DETAILED DESCRIPTION OF THE INVENTION

Figure 1:
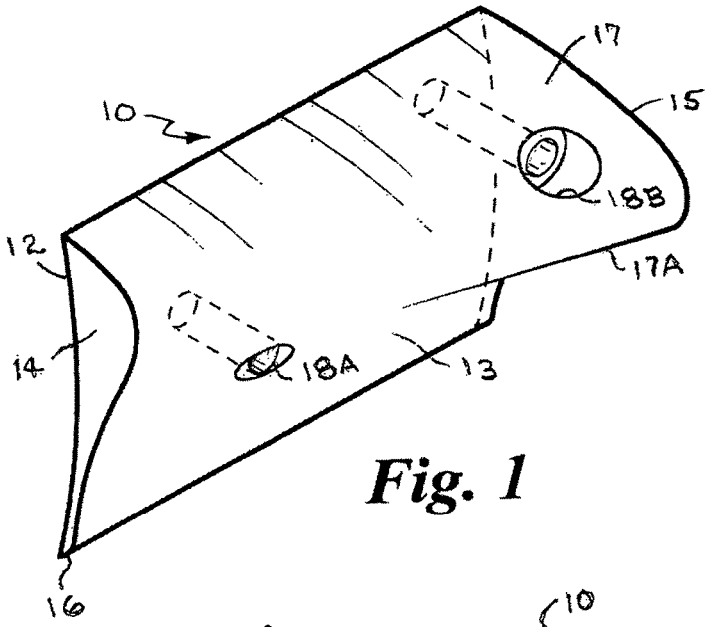
FIG. 1 is a perspective view of a foot lift attachment in accordance with the present invention.
Figure 5:
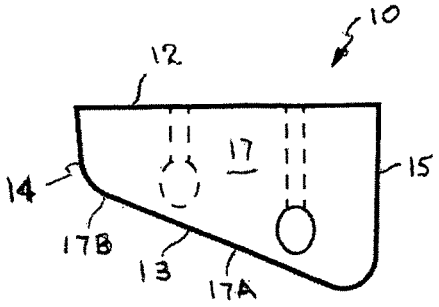
FIG. 5 is a top plan view of the foot lift attachment.
Figure 2:
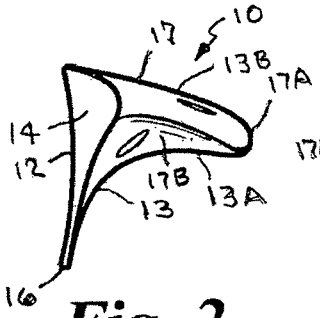
FIG. 2 is a front elevation view of the foot lift attachment.
Figure 3:
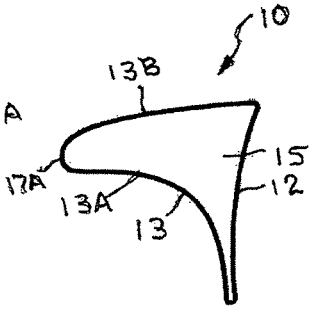
FIG. 3 is a rear elevation view of the foot lift attachment.
Figure 4:
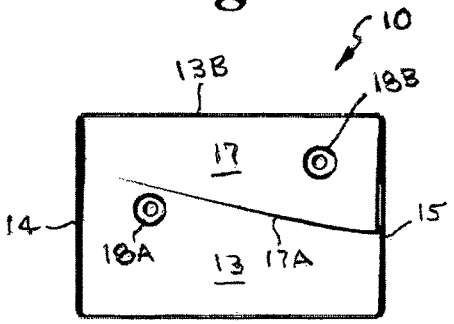
FIG. 4 is right side view of the foot lift attachment.

It should be understood that the foot lift attachments of the present invention are provided in pairs, one right foot lift attachment for receiving the right foot of the rider and one left foot lift attachment for receiving the left foot of the rider. The configurations of the right foot lift attachment, and the left foot lift attachment are mirror images of one another. Therefore, to avoid confusion and utilize terminology that cover both of the right and left foot pieces, in some of the following descriptions and illustrated examples, only a right foot lift attachment, designated generally as 10 is shown wherein the left hand side is referred to as the "inner facing side" 12 that faces toward the center the of the board, and the right hand side is referred to as the "outer facing side" 13 that faces toward an end of the board. The "front end" 14 refers to the end that faces toward the rider, and the "back end" 15 refers to the end that faces away from the rider. In some drawing figures where both the right and left foot lift attachments are shown, the right foot lift attachment is designated generally as 10 and the left foot lift attachment is designated generally as 11. As used herein, the term "foot" is used in a broad sense to refer to a rider's foot including a shoe or footwear worn on the foot. The terms "medial" and "medial side" refer to the inner side of a foot including a shoe or footwear, and the terms "lateral" and "lateral side" refer to the outer side of the foot including a shoe or footwear worn on the foot.

Referring to FIGS. 1-6, there is shown a foot lift attachment designated generally as 10 (also the foot lift attachment 11) having a horizontally elongated body with a concave curved inner facing side wall 12 and a concave curved outer facing side wall 13 extending horizontally between a flat vertical front end wall 14 and a flat vertical back end wall 15, and vertically upward from a narrow bottom end wall 16, terminating in a contiguous convex curved top end wall 17.

The radius of curvature of the concave curved inner facing side wall 12 is greater than the radius of curvature of the concave curved outer facing side wall 13, and is sized to be engaged on a curved support surface (described hereinafter). The lower portion 13A of the concave curved outer facing side wall 13 curves upwardly and outwardly in opposed relation to the inner facing side wall 12 and its upper portion 13B curves inward at its juncture with the contiguous convex curved top end wall 17. The contiguous convex curved top end wall 17 has a curved outer end 17A that extends laterally outward from its juncture with the front end wall 14 and tapers rearwardly and angularly outwardly to its juncture with the back end wall 15.

Figure 6:
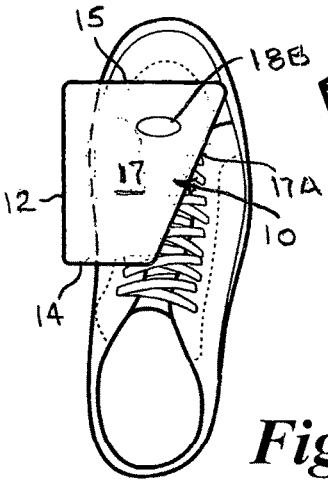
FIG. 6 is a top plan view of the foot lift attachment illustrating a foot lift attachment received on and overlapping the medial side and a top portion of the skateboard rider's foot and footwear worn on the foot.

The rounded outer end 17A of the top end wall 17 is thicker its juncture with the front end wall 14 and thinner at its juncture with the back end wall 15. The curved top end wall 17 has a concave curved underside 17B that is narrower at its juncture with the front end wall 14 and wider at its juncture with the back end wall 15 defining a curved surface configured to laterally receive and overlap the medial side and a top portion of a skateboard rider's foot and footwear worn on the foot, as illustrated in FIG. 6.

A first counter-bored hole 18A extends horizontally through the outer facing side wall 13, and a second counter-bored hole 18B extends horizontally through the top end wall 17 to receive cap screws for mounting the foot lift attachments 10 (and 11) on a curved support surface (described below).

Figure 7:
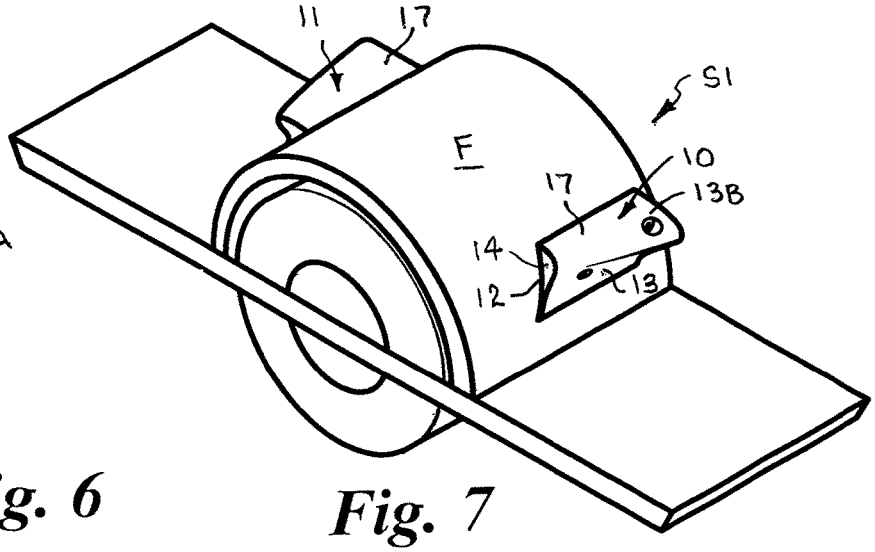
FIG. 7 is a perspective view of a pair of the foot lift attachments attached to the fender of a single-wheel wheel skateboard having a fender.

Referring now to FIG. 7 there is shown a perspective view of a single-wheel motorized electric skateboard S1 having a fender F with a right foot lift attachment 10 attached to one side of the fender and a left foot lift attachment 11 attached on the opposed side of the fender. It should be understood that holes are drilled through the fender F and the foot lift attachments 10 and 11 are secured to the fender by conventional hardware fittings such as cap screws installed in the counter-bored holes 18A and 18B and through the drilled holes and secured by lock washers and nuts on the underside of the fender.

The foot lift attachments 10 and 11 may also be secured to the fender F by welding, or integrally formed on the fender during a molding operation to form a fender for attachment to a skateboard.

Figure 8:
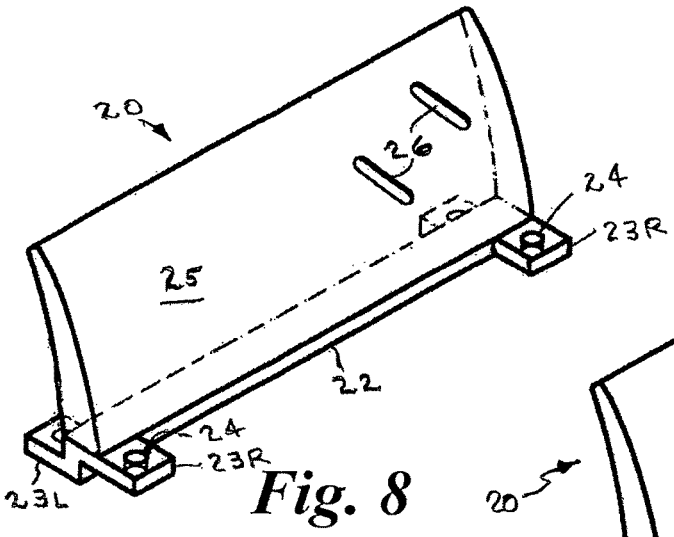
FIG. 8 is a perspective view of a mounting bracket for use in mounting the foot lift attachments on a single-wheel wheel skateboard having no fender.
Figure 9:
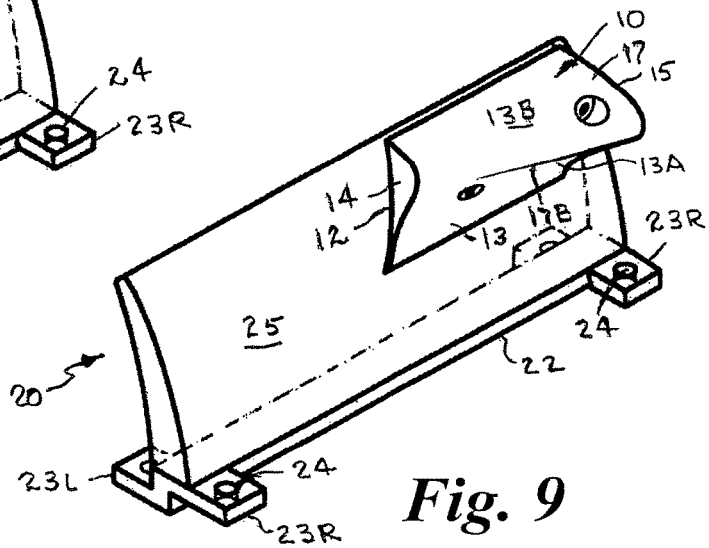
FIG. 9 is a perspective view of the mounting bracket with a foot lift attachment mounted thereon.
Figure 10:
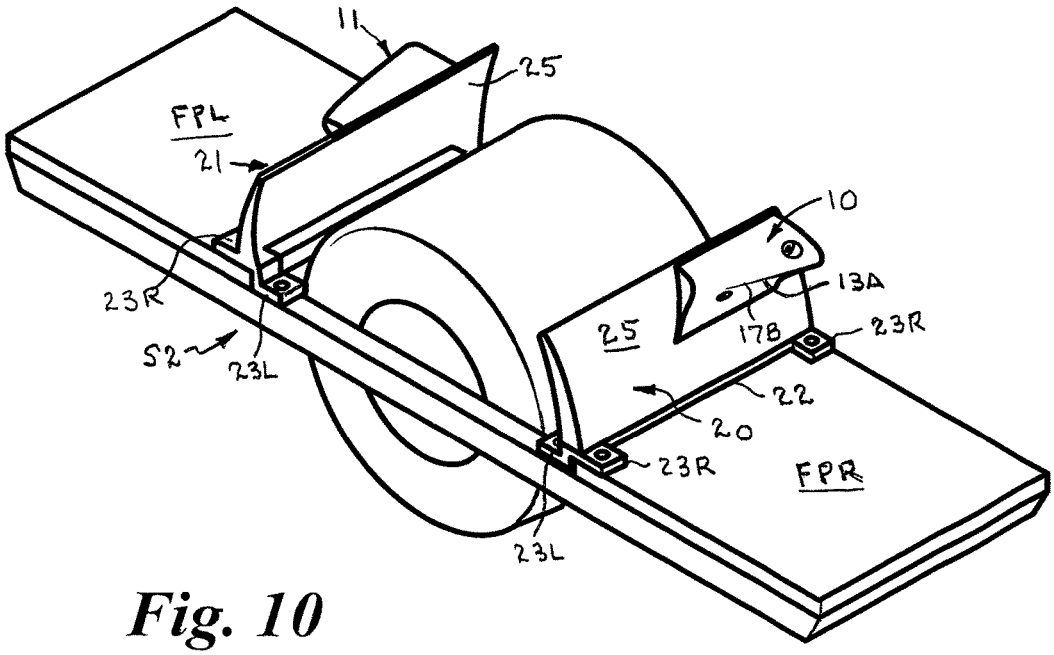
FIG. 10 is a perspective view of a pair of mounting brackets having foot lift attachments thereon that are mounted on a the deck of a single-wheel wheel skateboard adjacent to the right and left sides of the wheel opening.

Referring now to FIGS. 8, 9 and 10, there is shown a mounting bracket 20 for use in mounting the foot lift attachments 10 and 11 on a single-wheel motorized electric skateboard that does not have a fender. It should be understood that in FIGS. 8 and 9 only a right side mounting bracket 20 is shown, but that a left side mounting bracket 21, shown in FIG. 10, would also be provided which are mirror images of one another for mounting the right side foot lift attachment 10 and the left foot lift attachment 11, respectively. Each mounting bracket 20 and 21 has an elongated rectangular base member 22 with a first and a second short rectangular tab member 23R and 23L, respectively, at each end extending perpendicularly outward a short distance outwardly from opposed sides thereof.

The rectangular tab members 23R are disposed in a horizontal plane a short distance above the horizontal plane of the tab members 23L. The tab members 23R and 23L each have a hole 24 extending vertically therethrough for receiving a threaded screw or bolt. An arcuate curved mounting plate 25 extends a distance upwardly from the top of the elongated rectangular base member 22. The curved mounting plate 25 curves in the direction of the lower tab members 23L.

The curved mounting plate 25 is provided with a pair of pair of diagonal elongated slots 26 that extend transversely therethrough in parallel spaced relation. The spacing of the slots 26 correspond to the spacing of the counter-bored holes 18A and 18B of the foot lift attachments 10 and 11 and are secured to the curved mounting plate 25 by conventional hardware fittings such as cap screws installed in the counter-bored holes 18A and 18B and through the drilled holes and secured by lock washers and nuts on the inward facing side of the curved mounting plate. The diagonal slots 26 allow the height and horizontal placement of the foot lift attachments 10 and 11 to be selectively adjusted to the rider's preference.

Referring now to FIG. 10 there is shown a single-wheel wheel motorized electric skateboard S2 that does not have a fender. The foot deck of the skateboard has a frame FR with a wheel opening and right and left foot pads FPR, FPL, respectively, mounted on the frame at each side of the wheel opening, each configured to support a rider's foot. A right side mounting bracket 20 is attached to the right-hand side of the wheel opening and a left side mounting bracket 21 attached to the left-hand side of the wheel opening, each having a respective right foot lift attachment 10 and left foot lift attachment 11 mounted thereon.

It should be understood that holes are drilled through the frame FR and the right and left foot pads FPR, FPL, respectively and the foot lift attachments 10 and 11 are secured to the fender by conventional hardware fittings such as cap screws or bolts installed through the holes of the tab members 23R and 23L and the drilled holes and secured by lock washers and nuts on the underside of the frame and foot pads. When attached to the skateboard S2 that does not have a fender, the arcuate curved surfaces of the opposed mounting plates 25 serve as a partial fender and splash shields.

Figure 11:
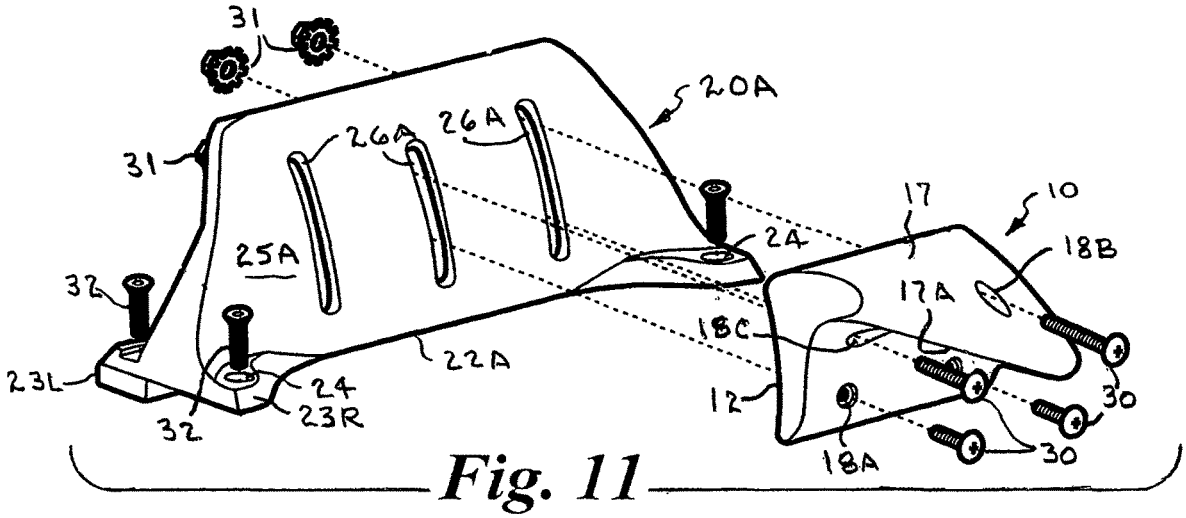
FIG. 11 is a perspective exploded view of an integrally formed mounting bracket and a foot lift attachment for use on a single-wheel wheel skateboard having no fender.
Figure 13:
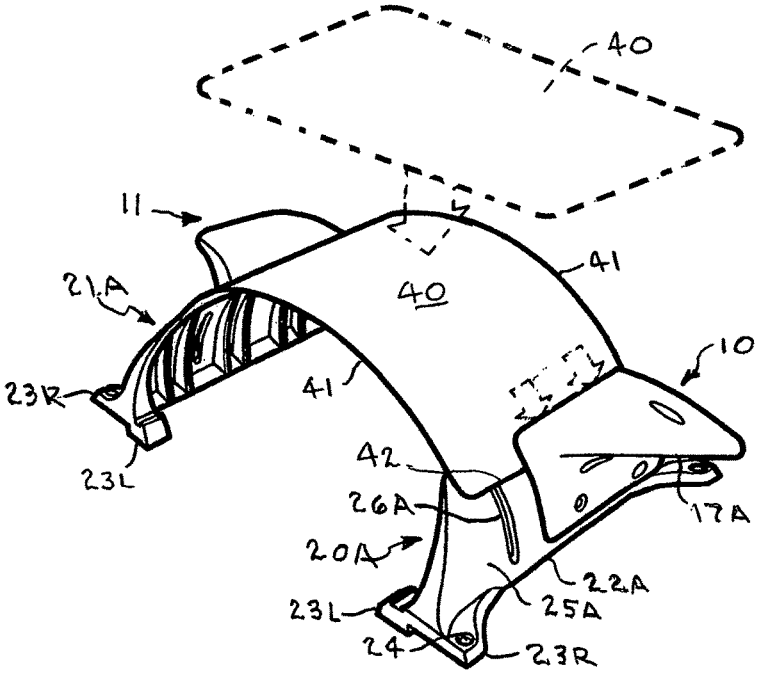
FIG. 13 is a perspective view of the shield member secured to a pair of the integrally formed mounting brackets and foot lift attachments.

FIG. 11 shows an integrally formed mounting bracket 20A similar to the mounting bracket 20 described previously for use in mounting the foot lift attachments on a single-wheel skateboard having no fender. It should be understood that in FIG. 11 only a right side mounting bracket 20A and a single foot lift attachment 10 is shown, but that a left side mounting bracket 21A and foot lift attachment 11 would also be provided which are mirror images of one another, as shown in FIG. 13. Each mounting bracket 20A and 21A has an elongated rectangular base portion 22A with a first and a second short rectangular tab member 23R and 23L, respectively, at each end extending perpendicularly outward a short distance outwardly from opposed sides thereof.

The rectangular tab members 23R are disposed in a horizontal plane a short distance above the horizontal plane of the tab members 23L. The tab members 23R and 23L each have a hole 24 extending vertically therethrough for receiving a threaded screw or bolt. An arcuate curved mounting plate portion 25A extends a distance upwardly from the top of the elongated rectangular base portion 22A. The curved mounting plate portion 25A curves in the direction of the lower tab members 23L.

The curved mounting plate portion 25A is provided with three elongated vertical slots 26A that extend transversely therethrough in parallel spaced relation. The spacing between the adjacent slots 26A correspond to the spacing of the counter-bored holes 18A and 18B of the foot lift attachments 10 and 11 (shown and described previously). The foot lift attachments may also be provided with a horizontal slot 18C. The three vertical slot arrangement provides more vertical adjustability allows a rider to selectively place one or both foot lift attachments closer to, or further away from, either longitudinal side edge of the skateboard.

In FIG. 11, the foot lift attachment 10 is shown as being secured to the curved mounting plate portion 25A by Philips head bolts 30 installed in the counter-bored holes 18A and 18B and/or the horizontal slot 18C and secured by Keps nuts 31 on the inward facing side of the curved mounting plate portion. A Keps nut (also called a K-nut or washer nut) is a nut with an attached, free-spinning washer. Allen head bolts 32 are installed through the holes 24 in the tab members 23R and 23L. These types of fasteners have been found to make assembly and adjustment more convenient.

Figure 12:
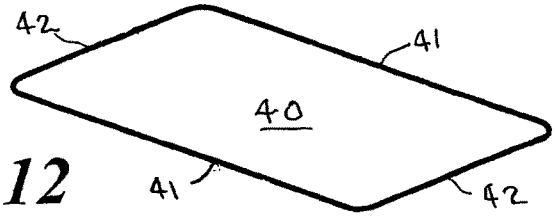
FIG. 12 is a perspective view of a shield member which may be used with the integrally formed mounting bracket and foot lift attachments for use on a single-wheel wheel skateboard having no fender.

FIG. 12 shows a shield member 40 for which may be used with the integrally formed mounting brackets 20A and 21A and foot lift attachments 10 and 11. The shield member 40 is formed of a sheet of still resilient material having an initial flat rectangular configuration laterally opposed longitudinal sides 41 and opposed ends 24.

As shown in FIG. 13 to install the initially flat stiff resilient shield member 40, the upper bolts 30 holding the foot lift attachments 10 and 11 on the curved mounting plate portion 25A of the mounting brackets 20A and 21A is slightly loosened to create a small gap therebetween. The shield member 40 is then manually bent into an arcuate curve and its opposed ends 42 are inserted into the gaps, as indicated by dashed arrows, and thereafter the loosened bolts are tightened to secure the shield member onto the mounting brackets. When attached to a skateboard that does not have a fender, the arcuate curved surfaces of the opposed mounting brackets 20A and 21A and the shield member 40 serve as a full fender and splash shield.

It should be understood from the foregoing descriptions, that of the rider of either of the single wheel skateboards S1 or S2 described above may move either or both of their feet laterally relative to the foot lift attachments 10 and 11 such that the concave curved underside 17B of the foot lift attachments receive and overlap the medial side and a top portion of the skateboard rider's foot and footwear worn on the foot to allow the rider to easily lift the skateboard by bending the knees and jumping to lift the skateboard off the ground to perform airborne maneuvers.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein.

Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A single-wheel electric skateboard comprising:

a longitudinal deck with a central wheel opening, a wheel positioned in the wheel opening operable for rotation, opposed ends of the deck extending away from the wheel opening, and foot receiving portions on the deck for receiving the feet of a rider with one foot on each side of the wheel opening; and a pair of foot lifts, each of said foot lifts comprising:

a mounting component having a lower end configured to be secured to the deck at opposed ends of the central wheel opening and a curved upper portion that extends over a portion of the wheel in radially spaced relation, and a foot receiving component positioned on the upper portion of said mounting component having a concaved curved inner surface facing away from said wheel toward a respective opposed end of said deck and a concave curved outer facing surface configured to laterally receive and releasably engage a medial side and a top portion of a rider's foot positioned on the respective foot receiving portions of the deck, wherein the radius of curvature of the concave curved inner surface is greater than the radius of curvature of the concaved curved outer surface, to enable the rider while having each foot engaged in the respective foot lifts to lift the single-wheel electric skateboard upward and off the ground by bending their knees and jumping upward to perform freestyle skateboarding maneuvers and aerial moves and jumps.

2. The single wheeled electric skateboard according to claim 1, wherein said mounting component is a mounting bracket having a curved side wall with a lower portion configured to be received and secured to the deck at opposed ends of the central wheel opening and a curved upper portion extending over a portion of the wheel in radially spaced relation; and said foot receiving component is a foot receiving member having a curved surface facing away from said wheel toward a respective opposed end of said deck configured to laterally receive and releasably engage a medial side and a top portion of a rider's foot, and wherein the concaved inner surface is configured to be received and mounted on the curved upper portion of said mounting bracket that extends over a portion of the wheel.

3. The single wheeled electric skateboard according to claim 2, wherein said foot receiving member has a pair of laterally spaced counter-bored holes extending therethrough, said curved upper portion of said mounting bracket has a pair of pair of diagonal elongated slots extending therethrough in parallel spaced relation, and cap screws installed in the counter-bored holes and through the slots and secured by lock washers and nuts on the inward facing side of the mounting bracket, whereby said foot receiving member is adjustably mounted on the curved upper portion of the mounting bracket to allow the height above the deck to be selectively adjusted to the rider's preference.

4. The single wheeled electric skateboard according to claim 2, further comprising: a generally rectangular shield member having opposed ends mounted on the curved upper portions of each said mounting bracket, respectively, and curved to extend over an upper portion of the wheel in radially spaced relation such that the curved surfaces of the opposed mounting brackets and the shield member serve as a fender and splash shield.

5. A a single-wheel electric skateboard, comprising:

a longitudinal deck with a central wheel opening, a wheel positioned in the wheel opening operable for rotation, opposed ends of the deck extending away from the wheel opening, and foot receiving portions on the deck for receiving the feet of a rider with one foot on each side of the wheel opening;

a curved fender member having opposed lower ends secured to the deck at opposed ends of the central wheel opening and a curved upper portion that extends over and covers an upper portion of the wheel in radially spaced relation; and a pair of foot lift members, each positioned on the curved upper portion of the fender member and each having a concave curved inner surface facing away from the fender member that curves outwardly from the fender member toward a respective opposed end of the deck and a concaved curved outer surface configured to laterally receive and releasably engage a medial side and a top portion of a rider's foot positioned on the respective foot receiving portions of the deck, wherein the radius of curvature of the concave curved inner surface is greater than the radius of curvature of the concaved curved outer surface, to enable the rider while having each foot engaged in the respective foot lift members to lift the single-wheel electric skateboard upward and off the ground by bending their knees and jumping upward to perform freestyle skateboarding maneuvers and aerial moves and jumps.

6. A single-wheel electric skateboard with foot lifts, comprising:

a longitudinal deck having a central wheel opening, a wheel positioned in the wheel opening operable for rotation, opposed ends of the deck extending away from the wheel opening, and foot receiving portions on the deck for receiving the feet of a rider with one foot on each side of the wheel opening;

a pair of curved components, each having a lower end secured to the deck at opposed ends of the central wheel opening and a curved upper portion that extends over at least a circumferential portion of the wheel in radially spaced relation; and a pair of foot lift members, each disposed at the upper portion of a respective curved component and each having a concaved curved inner wall that curves outwardly from the curved component toward a respective opposed end of the deck and a concaved curved outer wall configured to laterally receive and releasably engage a medial side and a top portion of a rider's foot positioned on the respective foot receiving portions of the deck, wherein the radius of curvature of the concave curved inner wall is greater than the radius of curvature of the concaved curved outer wall, to enable the rider while having each foot engaged in the respective foot lift members to lift the single-wheel electric skateboard upward and off the ground by bending their knees and jumping upward to perform freestyle skateboarding maneuvers and aerial moves and jumps.

7. The single-wheel electric skateboard with foot lifts according to claim 6, wherein: said pair of curved components comprise a pair of mounting brackets, each having a lower end secured to the deck at opposed ends of the central wheel opening and a curved upper portion that extends over a portion of the wheel in radially spaced relation.

8. The single-wheel electric skateboard with foot lifts according to claim 7, wherein: each said foot lift is adjustably mounted on the curved upper portion of the respective mounting bracket, to allow the height above the deck to be selectively adjusted to the rider's preference.

9. The single-wheel electric skateboard with foot lifts according to claim 6, wherein: said pair of curved components comprise a pair of curved fenders, each having a lower end secured to the deck at opposed ends of the central wheel opening and an arcuate curved upper portion that extends over a circumferential portion of the wheel in spaced relation.

10. The single-wheel electric skateboard with foot lifts according to claim 6, wherein: said pair of curved components comprise lower end portions of a curved fender secured to the deck at opposed ends of the central wheel opening and has a curved upper portion that extends over the top portion of the wheel in radially spaced relation.

11. A single-wheel electric skateboard comprising:

a longitudinal deck with a central wheel opening, a wheel positioned in the wheel opening operable for rotation, opposed ends of the deck extending away from the wheel opening, and foot receiving portions on the deck for receiving the feet of a rider with one foot on each side of the wheel opening; and a pair of foot lifts, each of said foot lifts comprising:

a mounting component having a lower end configured to be secured to the deck at opposed ends of the central wheel opening and a curved upper portion that extends over a portion of the wheel in radially spaced relation, wherein said mounting component is a mounting bracket having a curved side wall with a lower portion configured to be received and secured to the deck at opposed ends of the central wheel opening and a curved, and a foot receiving component positioned on the upper portion of said mounting component having a concaved curved inner surface facing away from said wheel toward a respective opposed end of said deck and a concave curved outer facing surface configured to laterally receive and releasably engage a medial side and a top portion of a rider's foot positioned on the respective foot receiving portions of the deck, wherein the radius of curvature of the concave curved inner surface is greater than the radius of curvature of the concaved curved outer surface, to enable the rider while having each foot engaged in the respective foot lifts to lift the single-wheel electric skateboard upward and off the ground by bending their knees and jumping upward to perform freestyle skateboarding maneuvers and aerial moves and jumps; and a generally rectangular shield member having opposed ends mounted on the curved upper portions of each said mounting bracket, respectively, and curved to extend over an upper portion of the wheel in radially spaced relation such that the curved surfaces of the opposed mounting brackets and the shield member serve as a fender and splash shield.

* * * * *